United States Patent [19]

Horlacher, Jr.

[11] Patent Number: 4,634,197

[45] Date of Patent: Jan. 6, 1987

[54] VACUUM CLEANER HOSE ADAPTER

[76] Inventor: Albert F. Horlacher, Jr., 420 N. Fleming Rd., Woodstock, Ill. 60098

[21] Appl. No.: 813,713

[22] Filed: Dec. 27, 1985

[51] Int. Cl.[4] ..... H01R 31/06

[52] U.S. Cl. ..... 339/16 R; 339/15

[58] Field of Search ..... 339/15, 16 R, 16 C; 174/47; 285/7

[56] References Cited

U.S. PATENT DOCUMENTS

| | | | |
|---|---|---|---|
| 2,516,883 | 8/1950 | Kelly | 285/7 |
| 2,516,907 | 8/1950 | Penfold | 285/7 |
| 3,034,085 | 5/1962 | Pauler et al. | 339/16 R |
| 3,387,319 | 6/1968 | Ferraris et al. | 15/327 |
| 3,434,092 | 3/1969 | Brown et al. | 339/16 |
| 3,553,629 | 1/1971 | Brown et al. | 339/15 |
| 4,012,091 | 3/1977 | Westergren | 339/15 |
| 4,018,493 | 4/1977 | Lyman et al. | 339/15 |
| 4,163,593 | 8/1979 | Kosik | 339/15 |
| 4,188,081 | 2/1980 | Holden et al. | 339/15 |
| 4,385,790 | 5/1983 | Genoa | 339/16 R |
| 4,473,923 | 10/1984 | Neroni et al. | 339/15 |
| 4,550,957 | 11/1985 | Keane | 339/16 R |
| 4,597,130 | 7/1986 | Lyman | 174/47 |

*Primary Examiner*—John McQuade

*Attorney, Agent, or Firm*—Neuman, Williams, Anderson & Olson

[57] ABSTRACT

A vacuum cleaner hose adapter comprises a single-walled generally cylindrical housing made of a non-conductive material which connects at one end to an electrified vacuum cleaner hose receptacle and which connects at the other end to a vacuum cleaner hose. Electrical conductors which run within bores in the housing wall supply electrical energy to the hose from electrical contacts in the vacuum cleaner receptacle. In operation, the adapter is inserted into a standard-type vacuum cleaner hose, and the electrical connector on the hose is engaged with the mating electrical connector on the adapter. The adapter is then plugged into the electrified vacuum cleaner hose receptacle to provide electrical power to the electrical connector on the hose via the electrical conductors of the adapter.

24 Claims, 6 Drawing Figures

FIG. 1
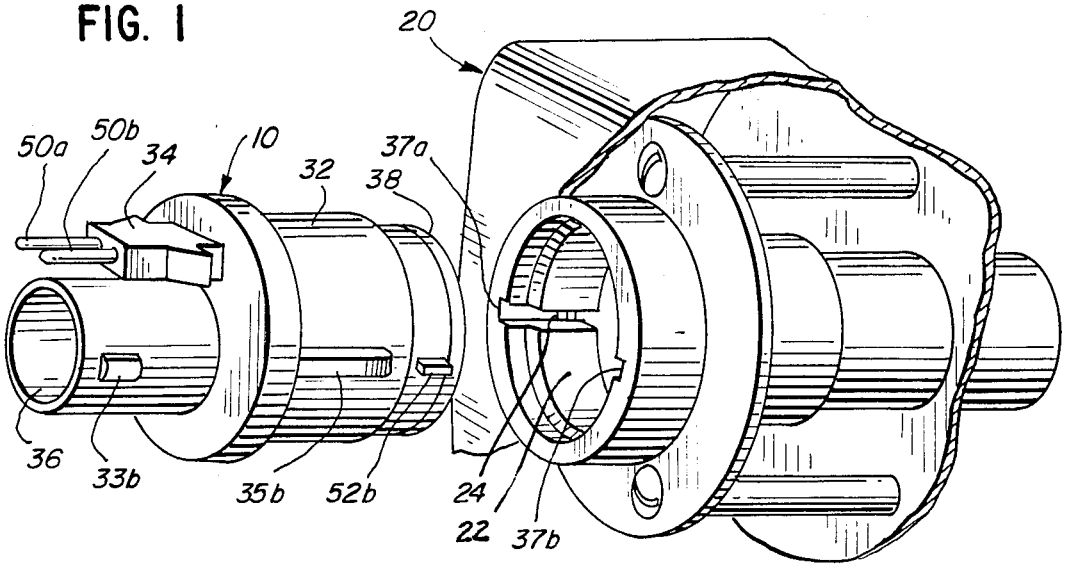
FIG. 2
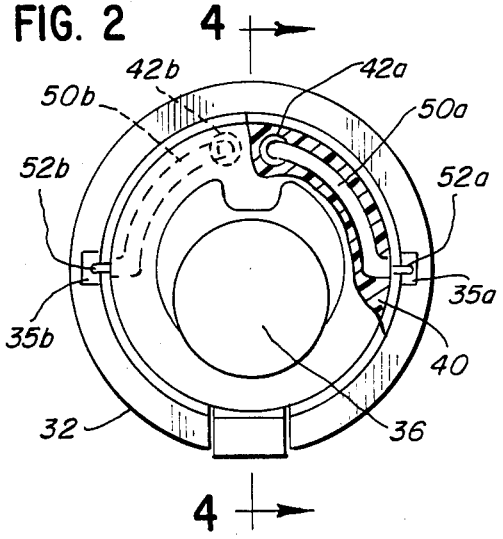
FIG. 3
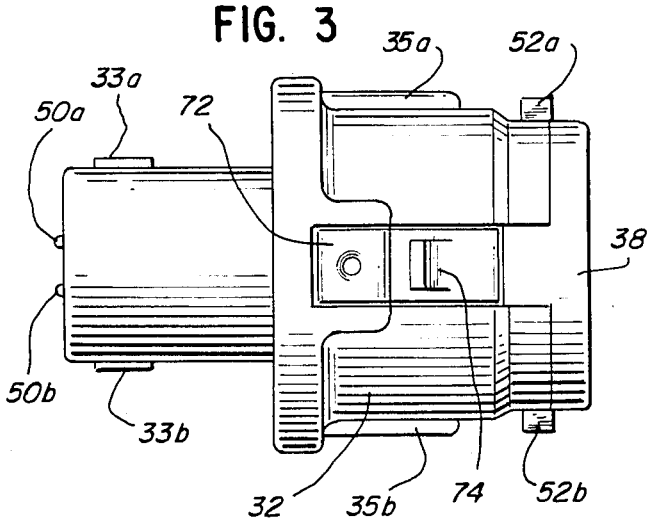
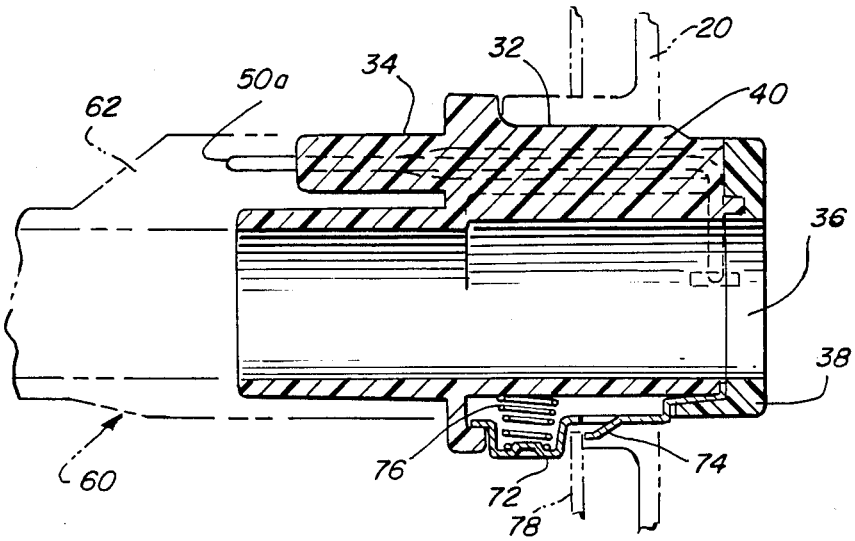
FIG. 4

FIG. 5
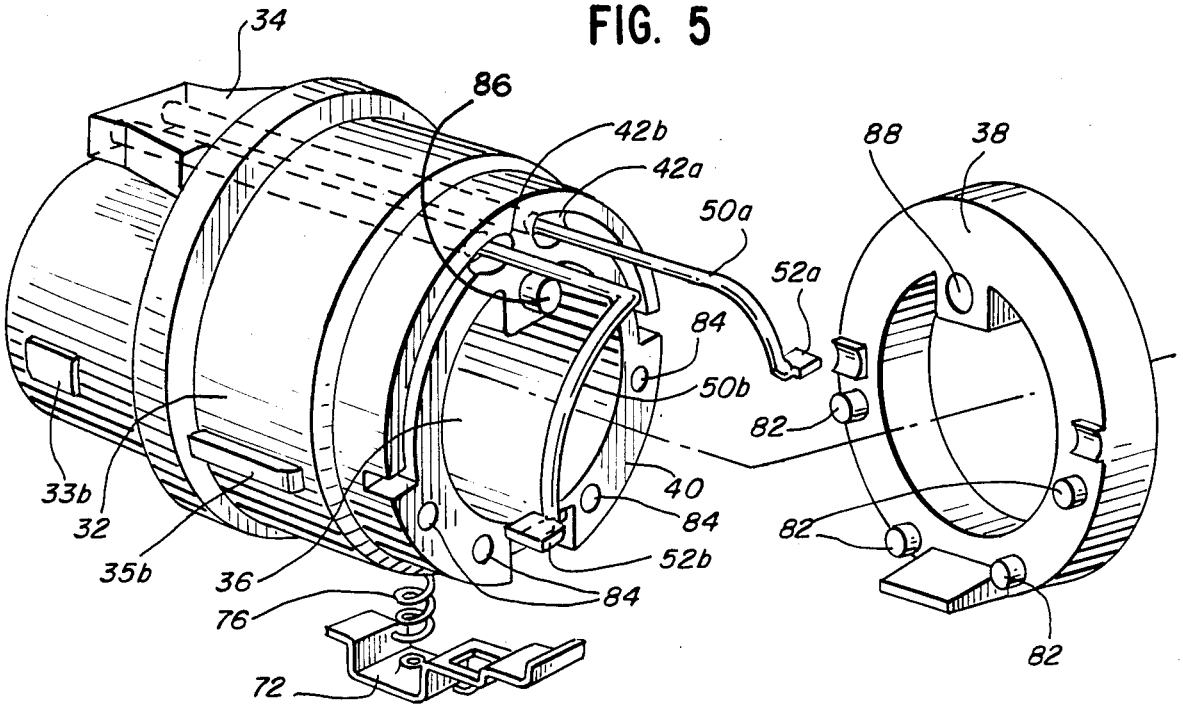
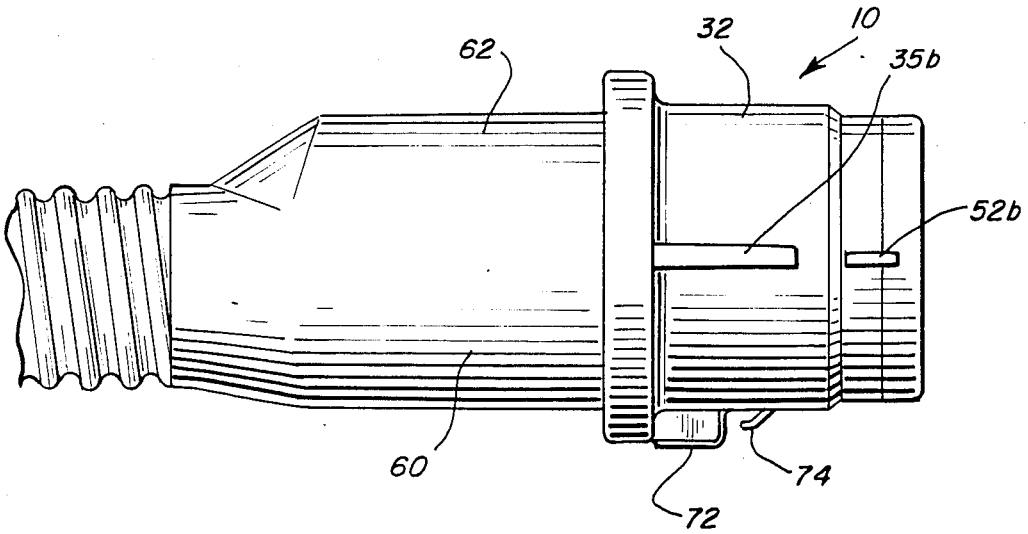
FIG. 6

VACUUM CLEANER HOSE ADAPTER

This invention relates to a vacuum cleaner hose adapter, and more particularly, to an adapter which enables standardized vacuum cleaner hoses to be used with existing vacuum cleaners having hose receptacles with built-in electrical contacts. The present invention thus obviates the need to use specially fabricated or custom-made replacement hoses with those existing vacuum cleaners.

The present invention is particularly directed to a vacuum cleaner hose adapter for adapting standardized vacuum cleaner hoses to an electrified vacuum cleaner coupling as shown, for example, in U.S. Pat. No. 3,434,092. Electrified hoses used with the vacuum cleaner coupling of U.S. Pat. No. 3,434,092 require either specialized end fittings or complicated adapters. Hoses with specialized end fittings may be difficult to obtain commercially in some instances and, when available, they are relatively expensive. Known vacuum cleaner hose adapters for use with the vacuum cleaner coupling of U.S. Pat. No. 3,434,092 have, to date, been relatively complex in design and, therefore, expensive to manufacture and assemble. For example, U.S. Pat. No. 4,385,790 describes a vacuum cleaner hose end adapter for use in the electrified vacuum cleaner coupling shown in U.S. Pat. No. 3,434,092. However, the adapter design offered by this patent suffers from several disadvantages. First, the adapter is made up of many components, some of which are quite small, making the manufacture of the individual components a burdensome and intricate task. Second, the large number of parts making up the adapter of U.S. Pat. No. 4,385,790 causes the process of assembling the adapter to be rather tedious and time-consuming, thereby increasing the overall cost to make the adapter. Third, the adapter housing member described in U.S. Pat. No. 4,385,790 is metallic, and therefore quite susceptible to short-circuiting and to the possibility of delivering an electrical shock (see col. 3, 11. 16–19). Fourth, the adapter shown in U.S. Pat. No. 4,385,790 comprises several cooperating parts, thereby creating a likelihood of wear and tear and, eventually, failure, as the housing parts are rubbed together during typical vacuum cleaner use.

The present invention is directed to overcoming these and other difficulties inherent in the prior art. In the present invention, a simple vacuum cleaner hose adapter is provided which enables a standardized, readily available, and inexpensive electrified hose to be adapted to a vacuum cleaner having a hose receptacle with built-in electrical contacts, particularly the specialized electrified hose receptacle of the general type shown in U.S. Pat. No. 3,434,092, incorporated herein by reference. A small number of parts are employed which has the effect of not only reducing cost, but also reducing the possibility of failure due to breakage. In addition, the adapter housing comprises a single-walled generally cylindrical member made out of a non-conductive material, thereby decreasing the risk of short-circuiting and electrical shock.

In the context of this specification, the adapter of the present invention can be (1) sold separately, that is, apart from the vacuum cleaner and hose, or (2) sold as a connector within a hose as part of a replacement hose/connector assembly, or (3) sold as original equipment, that is, the connector of the original hose.

OBJECTS OF THE INVENTION

An object of this invention is to provide a vacuum cleaner hose adapter which can adapt standardized vacuum cleaner hoses for use with existing vacuum cleaners having hose receptacles with built-in electrical contacts.

It is another object of this invention to provide a vacuum cleaner hose adapter that is simple in design and which incorporates a minimum number of parts so that the adapter will withstand rough usage during typical vacuum cleaner operation.

It is a further object of this invention to provide a hose adapter that can be easily and inexpensively assembled during its manufacture.

It is a still further object of the invention to provide a hose adapter which incorporates a one-piece housing to minimize the possibility of failure or separation of the housing components due to friction generated between the components and other similar wear and tear that inevitably occurs during normal vacuum cleaner operation.

Yet another object of this invention is to provide a durable hose adapter that minimizes the risk of short-circuits and injury due to electrical shock.

Further and additional objects will appear from the description, accompanying drawings and appended claims.

SUMMARY OF THE INVENTION

The above and other objects are accomplished in accordance with this invention by providing a vacuum cleaner hose adapter for use with a vacuum cleaner having a hose receptacle with electrical contacts built therein. The adapter comprises a generally cylindrical housing means at one end, i.e., the "suction" end, for being received in and lockingly engaging the electrified vacuum cleaner hose receptacle, and means at the other or "hose" end for engaging a vacuum cleaner hose. The adapter housing communicates suction developed in the vacuum cleaner to the hose engaged at the other end of the housing. The adapter includes connector means at the "hose" end of the housing for receiving the mating electrical connector of the vacuum cleaner hose. The adapter housing comprises a single-walled cylindrical member made of a non-conductive material and having a pair of longitudinally extending bores formed therein. A pair of electrical conductors run within the pair of bores and terminate in a pair of electrical contact members which project outwardly from the adapter housing at diametrically opposed sidewall locations. These electrical contact members are located so as to electrically contact mating electrical contacts within the vacuum cleaner hose receptacle when the "suction" end of the adapter housing is received in the hose receptacle. Thus, electrical energy is supplied from the vacuum cleaner to the mating electrical connector on the hose via the adapter's electrical conductors when the adapter housing is received in the vacuum cleaner hose receptacle.

In a preferred arrangement, the electrical connector on the adapter housing is a male connector adapted to receive a mating female connector from a vacuum cleaner hose.

BRIEF DESCRIPTION OF THE DRAWINGS

FIG. 1 is a perspective view, partly in section, of a vacuum cleaner hose adapter in accordance with one embodiment of the present invention, and particularly illustrating the manner in which the adapter is inserted into the electrified vacuum cleaner hose receptacle.

FIG. 2 is an end view, partly in section, of the vacuum cleaner hose, adapter assembly of FIG. 1;

FIG. 3 is a bottom view of the vacuum cleaner hose adapter shown in FIG. 1;

FIG. 4 is a cross-sectional view of the vacuum cleaner hose end adapter shown in FIG. 1 taken in the direction of arrows 4—4 in FIG. 2;

FIG. 5 is an exploded perspective view of the adapter in its disassembled state;

FIG. 6 is a side view of the vacuum cleaner hose adapter, particularly illustrating the manner in which a vacuum cleaner hose is engaged thereon prior to insertion into the electrified vacuum cleaner hose receptacle.

DETAILED DESCRIPTION OF THE PREFERRED EMBODIMENT

Turning first to FIG. 1 of the drawings, vacuum cleaner hose adapter 10 is shown adjacent to electrified hose receptacle 22 of vacuum cleaner 20. Adapter 10 comprises a generally cylindrical housing 32, one end of which, i.e., the "suction" end, is received in receptacle 22 and the other end of which, i.e., the "hose" end, engages a vacuum cleaner hose. The "hose" end of housing 32 is shown on the left side of FIG. 1; the "suction" end of housing 32 is shown toward the right in FIG. 1. Housing 32 communicates suction developed in vacuum cleaner 20 to the hose engaged to the "hose" end of housing 32 via inner cylindrical passageway 36.

As shown in FIG. 6, the "hose" end of adapter 10 receives a mating electrical connector 62 which is integral with and located on the periphery of hose 60. Electrical energy supplied to connector 62 is transmitted by conductors within hose 60 to operate electric attachments such as electric brushes or sweepers (not shown). FIG. 5 shows that connector 34 is fabricated with projecting barbs that mate with channels (not shown) within mating electrical connector 62 to form a somewhat permanent assembly between hose 60 and adapter 10. Raised rectangular pads, one of which is shown in FIG. 5 as pad 33*b*, project from diametrically opposed side wall locations on housing 32. Rectangular pads 33*a* and 33*b* mate with corresponding indentations on the inside surface of hose 60 (not shown) to provide an interference lock fit between adapter 10 and hose 60.

The components which make up vacuum cleaner hose adapter 10 are more particularly illustrated in FIG. 5. Housing 32 comprises a single generally cylindrical wall 40 having a pair of longitudinally extending bores 42*a* and 42*b* formed therein. The penetration of bores 42*a* and 42*b* into wall 40 is illustrated by the phantom lines shown in FIG. 5. A pair of electrical conductors 50*a* and 50*b* are carried within bores 42*a* and 42*b*, respectively. It is noted that bores 42*a* and 42*b* do not penetrate the inner surface of wall 40 so that communication between electrical conductors 50*a* and 50*b* and passageway 36 is avoided, and the likelihood of short-circuits caused by metallic materials in passageway 36 contacting conductors 50*a* and 50*b* is reduced.

In assembled form, conductors 50*a* and 50*b* project from connector 34 as illustrated in FIG. 1. Conductors 50*a* and 50*b* terminate in a pair of electrical contact members 52*a* and 52*b* as shown in FIG. 5.

FIG. 2 shows that electrical contact members 52*a* and 52*b* project outwardly at diametrically opposed sidewall locations on housing 32. Electrical contact members 52*a* and 52*b* are located so as to electrically contact corresponding mating electrical contacts within hose receptacle 22 of vacuum cleaner 20. As shown in FIG. 1, the electrical contact members (only one of which, 52*b*, is illustrated) will electrically contact mating electrical contacts within receptacle 22, one of which is illustrated in FIG. 1 as electrical contact 24.

Adapter 10 further comprises a means for lockingly engaging the vacuum cleaner hose receptacle 22. As shown in FIG. 4, a clip 72 is mounted on the outer surface of housing 32, and is frictionally engaged between housing 32 and end cap 38. Clip 72 has a tab 74 projecting outwardly therefrom for lockingly engaging adapter 10 within receptacle 22. A resilient means, shown in FIG. 4 as coil spring 76, is disposed between clip 72 and housing 32 so as to bias clip 72 in a normally outward direction from housing 32. Thus, adapter 10 is removed from vacuum cleaner hose receptacle 22 by depressing clip 72 inwardly to disengage tab 74 from receptacle lip 78. Of course, a clip fabricated from a self-springing material could be substituted for the clip and coil spring combination illustrated in FIG. 4 to eliminate the need for separate coil spring 76 and thereby decrease the overall number of parts which make up adapter 10.

A pair of ribs, one of which is illustrated in FIG. 5 as rib 35*b*, project from housing 32 at diametrically opposed side wall locations. As shown in FIG. 1, the ribs are inserted into cooperating channels 37*a* and 37*b* in vacuum cleaner hose receptacle 22. When adapter 10 is fully inserted into receptacle 22, ribs 35*a* and 35*b* prevent rotation of adapter 10 within receptacle 22, and thus ensure that contact is maintained between electrical contact members 52*a* and 52*b* and the mating electrical contacts within receptacle 22, one of which is shown in FIG. 1 as electrical contact 24.

As shown in FIG. 5, adapter 10 also comprises an end cap 38. When adapter 10 is assembled, end cap 38 provides a finished appearance and secures electrical contact members 52*a* and 52*b* in their proper diametrically opposed locations in housing 32. Cap 38 also secures clip 72 to the outer surface of housing 32 as illustrated in FIG. 4. End cap 38 is aligned with and attached to housing 32 by means of studs 82 secured in holes 84 of wall 40 and stud 86 of wall 40 secured in hole 88 of end cap 38. End cap 38 may be secured to housing 32 by any of a number of known fastening means, preferably not employing metallic fasteners, such as, for example, ultrasonic welding, heat sealing, adhesives, and interference lock fitting. Of course, known fasteners such as screws and rivets may also be employed, but these fasteners, if metallic, would increase the danger of short-circuiting and electrical shock unless thoroughly insulated.

The manner in which a standardized vacuum cleaner hose engages adapter 10 is illustrated in FIG. 6. As shown, the "hose" end of housing 32 receives mating electrical connector 62 on vacuum cleaner hose 60. In the illustrated embodiment, mating electrical connector 62 is shown as a female connector which is adapted to receive mating male connector 34 on adapter 10 (not shown). In another arrangement (not shown), the mating electrical connector of the hose is a male connector adapted to receive a mating female connector on the adapter.

In operation, the "hose" end of adapter 10 is first inserted into standardized vacuum cleaner hose 60 so that female connector 62 of hose 60 receives mating male connector 34 of adapter 10. The "suction" end of adapter 10 is then inserted into receptacle 22 so that electrical contact members 52*a* and 52*b* mate with electrical contacts within vacuum cleaner hose receptacle 22. When housing 32 is fully inserted into receptacle 22 of vacuum cleaner 20, electrical energy is supplied from the electrical contacts of receptacle 22 to female connector 62 of hose 60 via electrical contact members 52*a* and 52*b* and integral electrical conductors 50*a* and 50*b*.

Housing 32 and end cap 38 are preferably fabricated from a non-conductive plastic material that also exhibits high wear resistance. Especially preferable materials are acrylonitrile butadiene styrene resin (ABS) having flame retardants added thereto, polyvinyl chloride resin (PVC) (marketed by B.F. Goodrich Chemical Group under the trade name Geon) and ABS/PVC blends.

Several variations in the design of adapter 10 are possible to achieve manufacturing economies and efficiencies. As earlier described, a self-springing clip could be substituted for the slip and coil spring combination to decrease the overall number of components making up the adapter. Further variations to decrease the overall number of components of adapter 10 include:

(a) fabricating adapter housing 32 with electrical connectors 50*a* and 50*b* molded in place, thereby eliminating the need for separate end cap 38 and bores 42*a* and 42*b;*

(b) fabricating adapter housing 32 with molded-in-place electrical connectors as in (a) above, and further employing a self-springing clip, thereby eliminating end cap 38, bores 42*a* and 42*b*, and coil spring 76;

(c) fabricating adapter housing 32 with molded-in-place electrical connectors as in (a) above, and further incorporating a self-springing clip integrally molded with housing 32, thereby eliminating end cap 38, bores 42*a* and 42*b*, separate clip 72 and coil spring 76.

In view of the foregoing description, it will be apparent to those skilled in the art that the present invention provides a simple, durable adapter whereby inexpensive, standardized vacuum cleaner hoses rather than specially fabricated or custom-made hoses can be safely used with existing vacuum cleaners having built-in electrical connectors. In particular, it will be appreciated that the minimal number of components incorporated by the present invention decreases the amount of time needed to assemble and manufacture the adapter. In addition, the adapter of the present invention requires that only a small number of individual components be molded or otherwise fabricated. Thus, the cost to produce the adapter of the present invention is substantially reduced as compared with other adapters known in the art. Moreover, single-piece construction of the adapter housing from a non-conductive plastic material reduces the possibility of short-circuiting and electrical shock during use. Furthermore, it is apparent that the present invention incorporates a minimum number of cooperating parts so that wear and tear of the parts during typical vacuum cleaner operation is decreased, and the operating life of the adapter is thereby extended.

The adapter of the present invention may also be adapted for use with hoses having no electrical connectors associated with them. In such applications, adapter 10 is simply fabricated without connector 34 and electrical connectors 50*a* and 50*b* and inserted into a non-electrical hose for use with a vacuum cleaner having a hose receptacle of the type shown in U.S. Pat. No. 3,434,092.

While particular embodiments and application of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

I claim:

1. A vacuum cleaner hose adapter for use with a vacuum cleaner having a hose receptacle with electrical contacts therein, comprising:

(a) a generally cylindrical housing, said housing having means at one end for being received in and lockingly engaging the electrified vacuum cleaner hose receptacle, and means at the other end thereof for engaging a vacuum cleaner hose, said housing communicating suction developed in the vacuum cleaner to the hose engaged with said other end of said housing;

(b) connector means at said other end of said housing for receiving a mating electrical connector on a vacuum cleaner hose;

(c) said housing comprising a single-walled generally cylindrical member made of a non-conductive material and having a pair of longitudinally extending bores formed therein;

(d) a pair of electrical conductors running within said pair of bores, said pair of electrical conductors terminating in a pair of electrical contact members projecting outwardly at diametrically opposed side wall locations on said housing, and said electrical contact members being located so as to electrically contact mating electrical contacts within said vacuum cleaner hose receptacle when said one end of said housing is received in said hose receptacle;

whereby electrical energy is supplied from a vacuum cleaner to said mating electrical connector on said vacuum cleaner hose via said electrical conductors when said housing is received in said hose receptacle of the vacuum cleaner.

2. The vacuum cleaner hose adapter of claim 1 wherein said means at said other end of said housing is a male connector which is adapted to receive a mating female electrical connector on a vacuum cleaner hose whereby electrical energy is supplied to said female electrical connector.

3. The vacuum cleaner hose adapter of claim 2 wherein said male connector is integrally formed with said housing.

4. The vacuum cleaner hose adapter of claim 1 wherein said means at said other end of said housing is a female connector which is adapted to receive a mating male electrical connector on a vacuum cleaner hose whereby electrical energy is supplied to said male electrical connector.

5. The vacuum cleaner hose adapter of claim 4 wherein said female connector is integrally formed with said housing.

6. The vacuum cleaner hose adapter of claim 1 wherein said electrical contact members are integrally formed with said electrical conductors.

7. The vacuum cleaner hose adapter of claim 1 wherein said means for lockingly engaging said electrified vacuum cleaner hose receptacle comprises a clip mounted on the outer surface of said housing, said clip having a tab projecting therefrom for lockingly engaging said receptacle, and a spring disposed between said clip and said housing whereby said clip is normally biased outwardly from said housing.

8. The vacuum cleaner hose adapter of claim 1 wherein said means for lockingly engaging said electrified vacuum cleaner hose receptacle comprises a clip mounted on the outer surface of said housing, said clip fabricated from a self-springing material whereby said clip is normally biased outwardly from said housing.

9. The vacuum cleaner hose adapter of claim 8 wherein said clip is integrally formed with said housing.

10. A vacuum cleaner hose adapter for use with a vacuum cleaner having a hose receptacle with electrical contacts therein, comprising:

(a) a generally cylindrical housing, said housing having means at one end for being received in and lockingly engaging the electrified vacuum cleaner hose receptacle, and means at the other end thereof for engaging a vacuum cleaner hose, said housing communicating suction developed in the vacuum cleaner to the hose engaged with said other end of said housing;

(b) connector means at said other end of said housing for receiving a mating electrical connector on a vacuum cleaner hose;

(c) said housing comprising a single-walled generally cylindrical member made of a non-conductive material;

(d) a pair of electrical conductors molded in place within the wall of said cylindrical member, said pair of electrical conductors terminating in a pair of electrical contact members projecting outwardly at diametrically opposed side wall locations on said housing, and said electrical contact members being located so as to electrically contact mating electrical contacts within said vacuum cleaner hose receptacle when said one end of said housing is received in said hose receptacle;

whereby electrical energy is supplied from a vacuum cleaner to said mating electrical connector on said vacuum cleaner hose via said electrical conductors when said housing is received in said hose receptacle of the vacuum cleaner.

11. The vacuum cleaner hose adapter of claim 10 wherein said means for lockingly engaging said electrified vacuum cleaner hose receptacle comprises a clip mounted on the outer surface of said housing, said clip fabricated from a self-springing material whereby said clip is normally biased outwardly from said housing.

12. The vacuum cleaner hose adapter of claim 11 wherein said clip is integrally formed with said housing.

13. A vacuum cleaner hose combination adapted for use with a vacuum cleaner having a hose receptacle with electrical contacts therein, said vacuum cleaner hose combination comprising:

(a) a vacuum cleaner hose having a mating electrical connector;

(b) a vacuum cleaner hose connector comprising:

(i) a generally cylindrical housing, said housing having means at one end for being received in and lockingly engaging the electrified vacuum cleaner hose receptacle, and means at the other end thereof for engaging said vacuum cleaner hose, said housing communicating suction developed in the vacuum cleaner to said hose engaged with said other end of said housing;

(ii) connector means at said other end of said housing for receiving a mating electrical connector on said vacuum cleaner hose;

(iii) said housing comprising a single-walled generally cylindrical member made of a non-conductive material and having a pair of longitudinally extending bores formed therein;

(iv) a pair of electrical conductors running within said pair of bores, said pair of electrical conductors terminating in a pair of electrical contact members projecting outwardly at diametrically opposed side wall locations on said housing, and said electrical contact members being located so as to electrically contact mating electrical contacts within said vacuum cleaner hose receptacle when said one end of said housing is received in said hose receptacle;

whereby electrical energy is supplied from a vacuum cleaner to said mating electrical connector on said vacuum cleaner hose via said electrical conductors when said housing is received in said hose receptacle of the vacuum cleaner.

14. The vacuum cleaner hose combination of claim 13 wherein said means at said other end of said housing is a male connector which is adapted to receive a mating female electrical connector on a vacuum cleaner hose whereby electrical energy is supplied to said female electrical connector.

15. The vacuum cleaner hose combination of claim 14 wherein said male connector is integrally formed with said housing.

16. The vacuum cleaner hose combination of claim 13 wherein said means at said other end of said housing is a female connector which is adapted to receive a mating male electrical connector on a vacuum cleaner hose whereby electrical energy is supplied to said male electrical connector.

17. The vacuum cleaner hose combination of claim 16 wherein said female connector is integrally formed with said housing.

18. The vacuum cleaner hose combination of claim 13 wherein said electrical contact members are integrally formed with said electrical conductors.

19. The vacuum cleaner hose combination of claim 13 wherein said means for lockingly engaging said electrified vacuum cleaner hose receptacle comprises a clip mounted on the outer surface of said housing, said clip having a tab projecting therefrom for lockingly engaging said receptacle, and a spring disposed between said clip and said housing whereby said clip is normally biased outwardly from said housing.

20. The vacuum cleaner hose combination of claim 13 wherein said means for lockingly engaging said electrified vacuum cleaner hose receptacle comprises a clip mounted on the outer surface of said housing, said clip fabricated from a self-springing material whereby said clip is normally biased outwardly from said housing.

21. The vacuum cleaner hose combination of claim 20 wherein said clip is integrally formed with said housing.

22. A vacuum cleaner hose combination adapted for use with a vacuum cleaner having a hose receptacle with electrical contacts therein, said vacuum cleaner hose combination comprising:

(a) a vacuum cleaner hose having a mating electrical connector;

(b) a vacuum cleaner hose connector comprising:

(i) a generally cylindrical housing, said housing having means at one end for being received in and lockingly engaging the electrified vacuum cleaner hose receptacle, and means at the other end thereof for engaging said vacuum cleaner hose, said housing communicating suction developed in the vacuum cleaner to said hose engaged with said other end of said housing;

(ii) connector means at said other end of said housing for receiving a mating electrical connector on said vacuum cleaner hose;

(iii) said housing comprising a single-walled generally cylindrical member made of a non-conductive material;

(iv) a pair of electrical conductors molded in place within the wall of said cylindrical member, said pair of electrical conductors terminating in a pair of electrical contact members projecting outwardly at diametrically opposed side wall locations on said housing, and said electrical contact members being located so as to electrically contact mating electrical contacts within said vacuum cleaner hose receptacle when said one end of said housing is received in said hose receptacle;

whereby electrical energy is supplied from a vacuum cleaner to said mating electrical connector on said vacuum cleaner hose via said electrical conductors when said housing is received in said hose receptacle of the vacuum cleaner.

23. The vacuum cleaner hose combination of claim 22 wherein said means for lockingly engaging said electrified vacuum cleaner hose receptacle comprises a clip mounted on the outer surface of said housing, said clip fabricated from a self-springing material whereby said clip is normally biased outwardly from said housing.

24. The vacuum cleaner hose combination of claim 23 wherein said clip is integrally formed with said housing.

* * * * *